United States Patent [19]

Reczek et al.

[11] 4,363,865

[45] Dec. 14, 1982

[54] IMIDO METHYL BLOCKED PHOTOGRAPHIC DYES AND DYE RELEASING COMPOUNDS

[75] Inventors: James A. Reczek; Thomas R. Welter, both of Rochester, N.Y.

[73] Assignee: Eastman Kodak Company, Rochester, N.Y.

[21] Appl. No.: 240,348

[22] Filed: Mar. 4, 1981

[51] Int. Cl.[3] ..... G03C 7/00; G03C 5/54

[52] U.S. Cl. ..... 430/223; 430/224; 430/225; 430/242; 430/559; 430/562

[58] Field of Search ..... 430/222, 223, 224, 225, 430/242, 241, 559, 562

[56] References Cited

U.S. PATENT DOCUMENTS

| | | | |
|---|---|---|---|
| 4,142,891 | 3/1979 | Baigrie et al. . | |
| 4,147,544 | 4/1979 | Anderson et al. . | |
| 4,207,104 | 6/1980 | Chapman et al. . | |
| 4,263,393 | 4/1981 | Chen | 430/222 |
| 4,287,292 | 9/1981 | Chapman et al. | 430/222 |

OTHER PUBLICATIONS

Related Application: Ser. No. 220,408 filed 12-29-80, Reczek and Welter.

U.S. Ser. No. 174,406 filed 8/1/80.

European Published Application No. 9,989 filed 10-8-79.

Nefkens, *Nature,* 193, pp. 974-975, (1962).

Nefkens et al., *Rec. Trav. Chem.,* 82, pp. 941-953, (1963).

*Primary Examiner*—John E. Kittle

*Assistant Examiner*—John L. Goodrow

*Attorney, Agent, or Firm*—Harold E. Cole

[57] ABSTRACT

Imidomethyl blocked photographic image dyes and dye releasing compounds are useful in photographic elements, film units and processes. The blocked photographic dyes and dye releasing compounds have the structures:

I 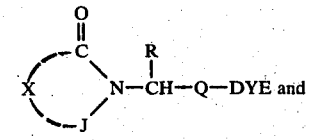

II 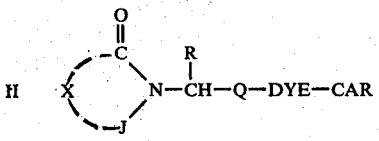

wherein:

J represents

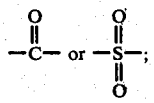

X represents the atoms to complete at least one 5- or 6-membered ring;

R represents hydrogen, alkyl of 1 to 4 carbon atoms or aryl of 6 to 12 carbon atoms;

Q represents

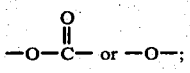

—Q—DYE represents the residue of a diffusible photographic dye; and

CAR is a ballasted carrier moiety from which the dye moiety is released as a function of silver halide development.

36 Claims, No Drawings

IMIDO METHYL BLOCKED PHOTOGRAPHIC DYES AND DYE RELEASING COMPOUNDS

This invention relates to photographic image dyes containing blocked functional groups and to photographic dye releasing compounds, elements, image transfer film units and processes employing them.

Color diffusion transfer elements, film units and processes employ, in the formation of color images, compounds which undergo an imagewise change in mobility of a dye as a function of silver halide development. A particularly useful class of compounds are immobile compounds which release a diffusible dye as a function (either direct or inverse) of silver halide development. Representative immobile compounds which release a diffusible dye are described for example in Fields et al U.S. Pat. No. 3,980,479; Fleckenstein U.S. Pat. No. 4,053,312; Koyama et al U.S. Pat. No. 4,055,428; Fleckenstein et al U.S. Pat. No. 4,076,529; Chasman et al U.S. Pat. No. 4,139,379; and Hinshaw et al U.S. Pat. Nos. 4,139,389, 4,199,354 and 4,199,355. These dye releasing compounds contain a ballasted carrier moiety joined to a diffusible dye moiety. During processing and as a function of silver halide development, the diffusible dye moiety is released from the carrier moiety.

Particularly advantageous diffusible dyes are the metallizable dyes described in Baigrie et al U.S. Pat. No. 4,142,891; Anderson et al U.S. Pat. No. 4,147,544; Chapman et al U.S. Pat. No. 4,207,104 and Reczek et al U.S. patent application Ser. No. 174,406 filed Aug. 1, 1980. Many of these dyes contain carboxy groups which act either as chelating sites for metallization of the dye subsequent to its release from the ballasted carrier, or as solubilizing groups to enhance diffusibility of the dye after release from the carrier, or both.

In preparing dye releasing compounds, attachment of a dye to a ballasted carrier frequently involves the reaction of an acyl or sulfonyl halide. If the dye contains free carboxyl groups, these groups can enter into unwanted side reactions unless they are blocked. Further, if the dye moiety of the dye releasing compound contains free carboxyl groups, it is possible for the dye moiety to form salts with metal ions present in the element. Salt formation can adversely affect the dispersibility, solubility and diffusibility of the dye releasing compound or the dye. Thus, it is desirable to block carboxy groups on the dye prior to attachment of the dye to a carrier and to retain the carboxy groups in their blocked form until a time contemporaneous with the release of the dye moiety from the carrier moiety, at which time the carboxy group should rapidly and uniformly unblock so as to permit metallization, or enhance diffusibility, or both.

Commonly employed techniques for blocking photographic dyes, such as converting the carboxy groups to alkyl esters, are not fully satisfactory. The alkyl esters are difficult to hydrolyze preferentially without cleaving other groups in the dye and do not unblock at a sufficiently rapid rate for use in those image transfer elements and film units where rapid diffusion of the dye is desired. Thus, there is a need for novel blocking groups and for dyes and dye releasing compounds blocked with them.

We have found that certain imidomethyl groups are highly effective in blocking carboxy groups, and other functional groups on photographic image dyes, such as hydroxy groups, and in particular, acidic hydroxy groups. These blocking groups are stable on storage yet uniformly unblock in a controlled manner during processing. They are inexpensive to make and undergo simple, uncomplicated reactions in the course of unblocking, giving rise to innocuous by-products.

In addition to protecting carboxyl groups contained in the dye from undergoing unwanted side reactions discussed above, the blocking groups shift the spectral absorption of the dye to shorter wavelengths when they are attached to an auxochromic group. This confers on the dyes and dye releasing compounds advantages associated with shifted dyes, such as the ability to be incorporated in silver halide emulsion layers without filtering radiation to which the emulsion is sensitive.

In accordance with one aspect of this invention there are provided photographic dyes and dye releasing compounds having the structures:

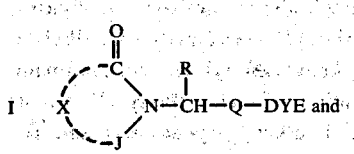

I

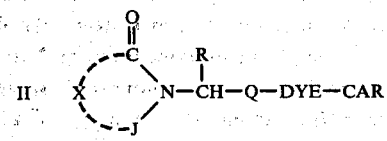

II wherein:

J represents

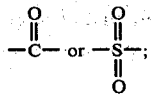

X represents the atoms to complete a heterocyclic nucleus containing at least one 5- or 6-membered ring;

R represents hydrogen, alkyl of 1 to 4 carbon atoms or aryl of 6 to 12 carbon atoms;

Q represents

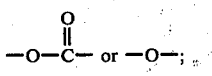

—Q—DYE represents the residue of a diffusible photographic dye; and

CAR is a ballasted carrier moiety from which the dye moiety is released as a function of silver halide development.

In another aspect this invention relates to a photographic element comprising a support bearing a silver halide emulsion layer having associated therewith a photographic dye or dye releasing compound as described above.

In yet another aspect this invention relates to an image transfer film unit comprising (a) a photosensitive element comprising a support bearing a layer of a silver halide emulsion having associated therewith a photographic dye releasing compound, as described above, and (b) a dye-image-receiving layer.

In still another aspect this invention relates to processes of forming photographic images with photographic elements and film units as described above.

In the above structural formulae, the moiety X, together with the group represented by J, can complete a mono-, bi- or tricyclic ring or ring system each ring of which contains 5 to 6 members. A preferred ring system is the phthalimide (1,3-isoindolinedione) ring system. Other useful ring systems include saccharin (1,2-benzisothiazolin-3-one-1,1-dioxide), succinimide, maleimide, hydantoin, 2,4-thiazolidinedione, hexahydro-2,4-pyrimidinedione, 1,2,3,6-tetrahydrophthalimide, and the like. These rings can be unsubstituted or substituted with a group or groups which modify the solubility or dispersibility of the dye or dye releasing compound, the reactivity of the dye releasing compound, the diffusibility of the dye, or the rate of unblocking of the blocking group. Representative substituents include halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl, alkenyloxycarbonyl and the like. The alkyl portions of these substituents contain from 1 to about 30 carbon atoms; the alkenyl portions of these substituents contain from 2 to about 30 carbon atoms and the aryl portions of these substituents contain from 6 to about 30 carbon atoms. The alkyl, aryl and alkenyl portions of these substituents can be further substituted with groups of the type specified above. Thus, alkyl is inclusive of e.g. aralkyl and aryloxyalkyl, aryl is inclusive of e.g. alkaryl and alkoxyaryl, and alkenyl is inclusive of aralkenyl. The amine portions of these substituents include primary, secondary and tertiary amines.

Preferred blocking groups of this invention have the structural formulae shown below, it being understood that these groups are joined to the dye or dye releasing compound at the location shown in structural Formulae I and II, above:

III

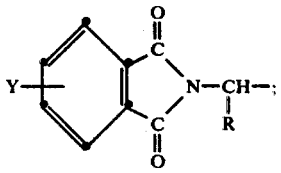

IV

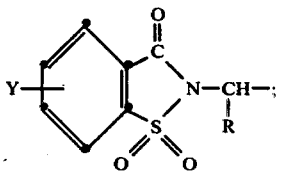

V

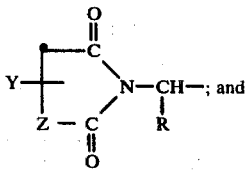

-continued

VI

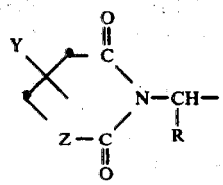

wherein:

R is as defined above;

Z is $$-\underset{\underset{Y}{|}}{CH}-,\ -S-\ \text{or}\ -\underset{\underset{Y}{|}}{N}-;$$

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl, alkenyloxycarbonyl and the like.

Specific blocking groups are shown below:

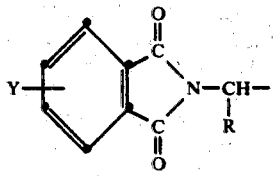

where Y and R have the values shown below.

| Y | R |
|---|---|
| —H | H |
| 4-$NO_2$ | H |
| 4-Cl | H |
| 4-$CH_3$ | H |
| 3-$CH_3$ | H |
| 4-$OCH_3$ | H |
| 4-$CON(C_2H_5)_2$ | H |
| 4-$CON(C_6H_{13})_2$ | H |
| 4-$SO_2NHC_3H_7$—i | H |
| 4-$SO_2N(C_2H_5)_2$ | H |
| —H | Ph |
| —H | $CH_3$ |
| 4-$CH_3SO_2$ | H |
| 4-COOH | H |
| 4-$COO(CH_2CH_2O)_2C_2H_5$ | H |
| 4-$COOCH_2C_6H_5$ | H |
| 4-$COOCH{=}CH_2$ | H |
| 4-$CON(C_{12}H_{25})_2$ | H |

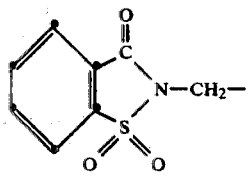

-continued

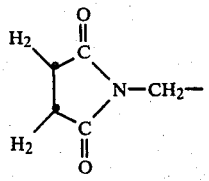

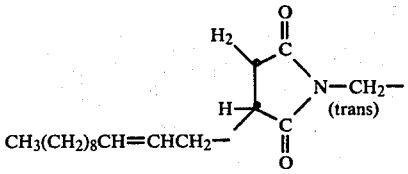

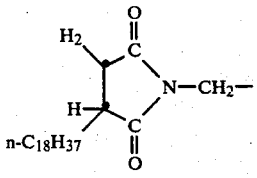

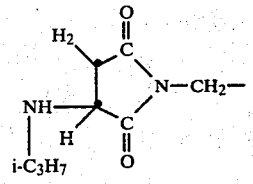

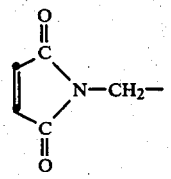

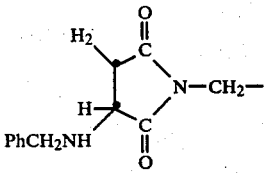

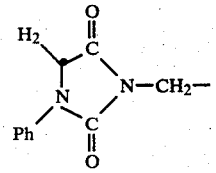

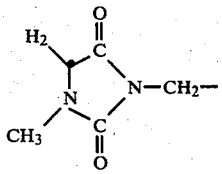

-continued

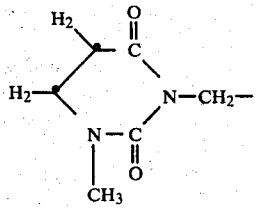

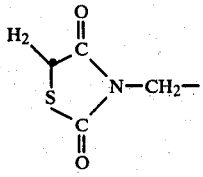

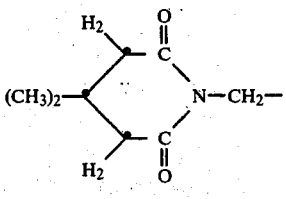

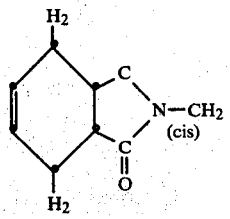

The diffusibile dye moiety, represented by

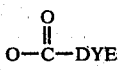

and O—DYE, to which the blocking group is attached, can be any of the dye moieties useful in photographic elements to provide preformed image dyes which have carboxyl or hydroxy grops available for derivatization with a blocking group. Particularly useful results are obtained when the groups blocked in accordance with this invention are acidic groups, such as carboxy groups or acidic hydroxy groups. An acidic hydroxy group is understood to be a hydroxy group having a pKa of 7 or less; pKa being the pH of an aqueous solution of the unblocked dye half neutralized with alkali and measured as described in E. Kosower, *Introduction To Physical Organic Chemistry,* Chapter 1, John Wiley & Sons, N.Y., 1968. Representative dyes include the phenylazonaphthyl dyes of U.S. Pat. Nos. 3,929,760, 3,931,144, 3,932,380, 3,932,381, 3,942,987, 3,954,476, 4,001,204 and 4,013,635; the phenylazopyrazoline dyes of U.S. Pat. No. 4,013,633; the arylazopyrazolotriazole and arylazopyridinol dyes of Baigrie et al U.S. Pat. No. 4,142,891 issued. Mar. 6, 1979; the arylazo dyes of Landholm et al U.S. Pat. No. 4,156,609 issued May 29, 1979 and Kilminster U.S. Defensive Publication No. T994003 published May 6, 1980; the heterocyclylazonaphthol dyes of Chapman U.S. Pat. No. 4,207,104, issued June 10, 1980; the pyridylazopyrazole and pyrimidylazopyrazole dyes of Green U.S. Pat. No. 4,148,641 issued Apr. 10, 1979; the pyridylazonaphthol dyes of Anderson et al U.S. Pat. No. 4,147,544 issued Apr. 3, 1979; the arylazopyridinol dyes of Chapman U.S. Pat. No. 4,195,994, issued Apr. 1, 1980 and Reczek et al U.S. Patent Application Ser. No. 174,406, filed Aug. 1, 1980; the arylazoisoquinolinol dyes of Chapman et al U.S. Pat. No. 4,148,642 issued Apr. 10, 1979 and the arylazoenol dyes of Chapman et al U.S. Pat. No. 4,148,643 issued Apr. 10, 1979.

Preferred dye and dye releasing compounds can be represented by the structural formulae:

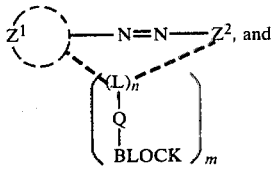

VII

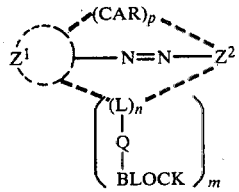

VIII wherein:

$Z^1$ represents the atoms to complete an aromatic carbocyclic or heterocyclic nucleus having at least one ring of 5 to 7 atoms, such as phenyl, naphthyl, pyridyl, pyrimidyl, pyrazolyl, indolyl, imidazoyl, pyrazolotriazolyl, isoquinolyl, etc.;

$Z^2$ represents a nucleus as defined for $Z^1$ or an acyclic unsaturated group in conjugation with the azo group, such as vinyl, butadienyl, etc.;

CAR is a ballasted carrier moiety as defined above;

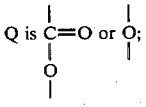

BLOCK is an imidomethyl blocking group of this invention as shown above in structural formulae I–VI;

L is a bivalent linking group, such as alkylene, arylene, oxyalkylene, oxyarylene, aminoalkylene, aminoarylene, sulfamoylalkylene, etc.;

m is 1 or 2;

n is 0 or 1 when Q is

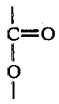

and is 0 when Q is 0; and p is ½, 1 or 2.

In the above structural formulae the subscripts m and $p_2$ and the dashed lines between the nuclei completed by $Z^1$, $Z^2$ and groups shown attached thereto indicate that these groups can be present on either or both of the nuclei. When p has a value of ½, two dye moieties are attached to one carrier moiety.

Especially preferred are metallizable azo dyes containing a blocked chelating carboxy group ortho to the point of attachment to the azo linkage group, and dye releasing compounds containing them, which can be represented by the structural formulae:

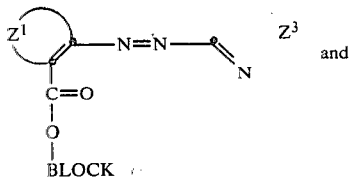

IX

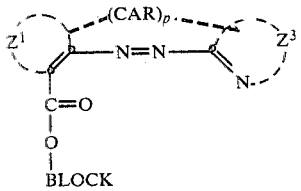

X wherein:

p is ½, 1 or 2;

$Z^1$ is as defined above;

$Z^3$ represents the atoms to complete an aromatic heterocyclic nitrogen containing nucleus having at least one ring of 5 to 7 atoms, such as pyridyl, pyrimidyl, pyrazolyl, indolyl, imidazolyl, pyrazolotriazolyl, isoquinolyl, etc.; and BLOCK and CAR are as defined above.

The ballasted carrier moiety represented by CAR can be any of the carriers from which an image dye is released as a function of silver halide development. Representative ballasted carrier moieties are described, for example, in U.S. Pat. No. 3,227,550 and Canadian Pat. No. 602,607 (release by chromogenic coupling); U.S. Pat. Nos. 3,443,939 and 3,443,940 (release by intramolecular ring closure); U.S. Pat. Nos. 3,628,952, 3,698,987, 3,725,062, 3,728,113, 3,844,785, 4,053,312, 4,055,428 and 4,076,529 (release after oxidation of carrier); U.S. Pat. Nos. 3,980,479, 4,199,355 and European patent application 12,908 (release unless carrier is oxidized); and U.S. Pat. Nos. 4,139,379, 4,139,389 and 4,232,107 (release after reduction of carrier).

The ballasted carrier moiety can be such that the diffusible dye moiety is released therefrom as a direct function of development of a silver halide emulsion. This is ordinarily referred to as negative-working dye release chemistry. Alternatively, the ballasted carrier moiety can be such that a diffusible dye moiety is released therefrom as an inverse function of development of a silver halide emulsion. This is ordinarily referred to as positive-working dye release chemistry.

A preferred class of ballasted carrier moieties for use in negative-working dye release compounds of this invention are the orthoor para-sulfonamidophenol and naphthol carries described in U.S. Pat. Nos. 4,053,312, 4,055,428 and 4,076,529. In these compounds the dye moiety is attached through a sulfonamido group which is ortho- or para to the phenolic hydroxy group and is released by hydrolysis after oxidation of the carrier moiety.

A preferred class of ballasted carrier moieties for use in positive-working dye release compounds, are the nitrobenzene and quinone carriers described in U.S. Pat. Nos. 4,139,379 and 4,139,389. In these compounds the dye moiety is attached to the carrier moiety via an electrophilic cleavage group ortho to the nitro group or the quinone oxygen, such as a carbamate group, and is released upon reduction of the carrier moiety.

A further preferred class of ballasted carrier moieties for use in positive-working dye release compounds are the hydroquinone carriers described in U.S. Pat. No. 3,980,479. In these compounds the dye moiety can be joined to a carbamate group ortho to one of the hydroquinone hydroxy groups.

A yet further preferred class of carriers for use in positive-working dye release compounds are the benzisoxazolone compounds described in U.S. Pat. Nos. 4,199,354 and 4,199,355. In these compounds the dye is attached to the carrier through an electrophilic group and is released unless a nucleophilic group adjacent the electrophilic group is oxidized.

The dyes and dye releasing compounds to be blocked in accordance with this invention are known compounds. Similarly precursors of the imidomethyl blocking groups are known compounds. A useful technique for blocking dyes and dye release compounds in accordance with this invention is as follows: a cyclic imide, such as phthalimide, is converted to the hydroxymethyl derivative by reaction with an aldehyde, such as formaldehyde. This is then converted to the halomethyl derivative by reaction with an acid chloride, preferably an inorganic acid chloride such as thionyl chloride or phosphoryl chloride. The blocking group is then attached to the dye or dye release compound by reaction of the N-halomethyl derivative prepared above with a salt, such as an alkali metal salt, of the carboxylic acid group or the acidic hydroxy group on the dye or dye release compound. This technique and other representative techniques for preparing blocked dyes and dye release compounds are shown in the preparative examples, infra.

To take full advantage of this invention, especially with dyes containing carboxy groups, it is preferred that the blocking group be attached to the dye prior to attachment of the dye to the carrier.

The photographic elements in which the photographic dyes and dye releasing compounds of this invention are incorporated can be simple elements comprising a support bearing a layer of a silver halide emulsion and the photographic dye or dye releasing compound. Preferred are multilayer multicolor silver halide elements and especially preferred are image transfer film units.

When blocking of the dye or dye releasing compound shifts its spectral absorption, it can be incorporated in the silver halide emulsion layer in order to obtain the benefits associated with such shifting. However, the dye or dye releasing compound can be incorporated in another layer where it will come into contact with silver halide development products during processing.

A typical multilayer multicolor photographic element according to this invention can comprise a support having thereon a red-sensitive silver halide emulsion unit having associated therewith a cyan-dye-image-providing material, a green-sensitive silver halide emulsion unit having associated therewith a magenta-dye-image-providing material and a blue-sensitive silver halide emulsion unit having associated therewith a yellow-dye-image-providing material, at least one of the dye-image-providing materials being a blocked dye or dye releasing compound of this invention. Each silver halide emulsion unit can be composed of one or more layers and the various units and layers can be arranged in different relationships with respect to one another in accordance with configurations known in the art. In an alternative format, the emulsions sensitive to each of the three primary regions of the spectrum can be disposed as a single segmented layer, e.g., as by the use of microvessels as described in Whitmore U.S. patent application No. 184,714 filed Sept. 8, 1980.

The photographic film units of this invention comprise:

(1) a photographic element as described above; and (2) a dye-image-receiving layer.

The dye-image-receiving layer in the film unit can be integral with the photographic element or located on a separate support adapted to be superposed on the photographic element after exposure thereof.

Any material can be employed as the dye-image-receiving layer in the film units of this invention as long as it will mordant, or otherwise fix, the dye which diffuses to it. The particular material chosen will, of course, depend upon the dye or dyes to be mordanted. The dye-image-receiving layer can contain ultraviolet absorbers to protect the dye image from fading due to ultraviolet light, brighteners and similar materials to protect or enhance the dye image, and the like.

In a preferred embodiment, the film units of this invention contain an alkaline processing composition and means containing same for discharge of the alkaline processing composition within the film unit. A preferred means is a rupturable container which is adapted to be positioned during processing of the film unit so that a compressive force applied to the container by pressure-applying members, such as would be found in a camera designed for in-camera processing, will effect a discharge of the container's contents within the film unit. However, other methods of introducing the alkaline processing composition can be employed.

In a preferred embodiment, the film units of this invention contain a cover sheet on the opposite side of the photosensitive layers from the dye image-receiving layer and the film unit is adapted for discharge of the alkaline processing composition between the cover sheet and the photosensitive layers. A preferred cover sheet comprises a support bearing a neutralizing layer (also referred to as a pH lowering layer or acid layer) and at least one timing layer (also sometimes referred to as a spacer layer or "inert" spacer layer.) Suitable materials for use in the neutralizing and timing layers are described in *Research Disclosure,* Vol. 123, Item 12331, July 1974 and Vol. 135, Item 13525 July 1975. (*Research Disclosure* is published by Industrial Opportunities Limited, Homewell, Havant, Hampshire, PO9, 1EF, U.K.)

In addition to the layers referred to above, the elements and film units can contain additional layers conventional in photographic elements and film units, such as spacer layers, filter layers, antihalation layers, scavenger layers, pH lowering layers (sometimes referred to as acid layers and neutralizing layers), timing layers, opaque reflecting layer, opaque light-absorbing layers and the like. Useful supports include polymeric films, paper (including polymer-coated paper), glass and the like.

The light-sensitive silver halide emulsions employed in the photographic elements and film units can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be negative working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice.

The dyes and dye releasing compounds of this invention can be incorporated in the silver halide emulsions, or in other vehicles used in the photographic elements, in the ways photographic dyes and dye releasing compounds are incorporated in such emulsions and vehicles in the art. Depending upon the physical properties of the dye or dye releasing compound and its physical compatibility with the emulsion or vehicle, it can be dispersed directly therein, it can be mixed with organic or aqueous solvents and then dispersed in the emulsion or vehicle, or it can be loaded in a latex which is then dispersed in the emulsion or vehicle. The latter technique is described in *Research Disclosure,* July 1977, Item 15930.

Further details regarding silver halide emulsions and elements and addenda incorporated therein can be found in *Research Disclosure,* December 1978, Item 17643.

Photographic images can be prepared with photographic elements of this invention by a variety of techniques. Those elements which simply contain a layer of shifted blocked dye on a support can be contacted with an imagewise pattern of base to yield an image of unblocked dye against a background of blocked dye. Representative techniques for generating an imagewise distribution of base are described in U.S. Pat. Nos. 3,451,814 and 3,451,815, (selective exhaustion of alkali as a function of silver halide development and transfer of unexhausted alkali to a receiver sheet) and *Research Disclosure,* February 1975, Item 13023, Paragraph V, pages 48 and 49 (generation of base by exposure and processing of a cobalt(III) complex.)

Additionally, photographic images can be prepared with the photographic elements of this invention by processing the element in accordance with known procedures for processing photographic elements containing preformed image dyes. Silver dye bleach processing can be employed as described, for example, in U.S. Pat. No. 3,684,513, Mees and James, *The Theory Of The Photographic Process,* pages 384 and 395, Third Edition, 1966, The MacMillan Co., or Friedman, *History Of Color Photography,* pages 405–429, 1944. Photographic elements and film units which contain dye releasing compounds of this invention, and which are designed for providing photographic images by diffusion transfer processes, can be processed as described in the numerous patents and articles relating thereto, a number of which have been referred to herein.

Inasmuch as the processes used with silver halide emulsions employ alkaline processing solutions for development or for other purposes, the blocking group will be cleaved from the dye or dye releasing compound concurrent with other processing steps.

Photographic color images can be formed with the nondiffusible dye-releasing compounds of this invention by treating an imagewise exposed element containing the dye-releasing compound with an alkaline processing solution to form an imagewise distribution of diffusible dye as a function of the imagewise exposure of the silver halide emulsion. Images can be formed employing the imagewise released diffusible dye, or the remaining imagewise distribution of nondiffusible compound, or both.

The released diffusible dye can be allowed to diffuse to a receiver sheet or layer to form a transfer image. Alternatively, it can be removed from the element and not used further.

When the imagewise distribution of diffusible dye is used to form an image or not, the remaining nondiffusible compound can be used as a retained image in the layer in which it was initially coated. This could include removing residual silver and silver halide by any conventional procedure known to those skilled in the art, such as a bleach bath followed by a fix bath, a bleach-fix bath, etc.

Alternatively, once the initially formed diffusible dye is removed from the element, the residual nondiffusible compound can be employed to form a transfer image by treating it to yield a second distribution of diffusible dye which can be transferred to a suitable receiver sheet or layer.

Accordingly, a preferred process for producing a photographic image in color according to this invention comprises:

(a) treating an imagewise exposed photographic element, as described above, with an alkaline processing composition in the presence of a silver halide developing agent to effect development of each of the exposed silver halide emulsion layers, thereby (b) releasing imagewise a diffusible dye as a function of the development of each of the silver halide emulsion layers; and (c) diffusing at least a portion of the imagewise distribution of diffusible dye out of the layer in which it is coated.

The alkaline processing composition employed in this embodiment can be an aqueous solution of an alkaline material, such as an alkali metal hydroxide or carbonate (e.g. sodium hydroxide or sodium carbonate) or an amine (e.g. diethylamine). Preferably the alkaline composition has a pH in excess of 11. Suitable materials for use in such compositions are disclosed in *Research Disclosure,* pages 79–80, November 1976.

Preferably the developing agent is contained in the alkaline processing composition, although it can be contained in a separate solution or process sheet, or it can be incorporated in a layer of the photographic element or film unit. When the developing agent is separate from the alkaline processing composition, the alkaline composition serves to activate the developing agent and provide a medium in which the developing agent can contact and develop developable silver halide.

A variety of silver halide developing agents can be used with the elements and film units of this invention. The choice of a particular developing agent will, to some extent, depend on the ballasted carrier moiety. Suitable developing agents can be selected from such compounds as hydroquinone, aminophenols, (e.g., N-methylaminophenol), 1-phenyl-3-pyrazolidone, 1-phenyl-4,-4-dimethyl-3-pyrazolidone, 1-phenyl-4-methyl-4-hydroxymethyl-3-pyrazolidone. Non-chromogenic developers are preferred for use in diffusion transfer film units, since they have a reduced propensity to stain dye image-receiving layers.

A preferred photographic film unit which can be processed in accordance with this invention, and which is adapted to be processed by passing the unit between a pair of juxtaposed pressure-applying members, such as would be found in a camera designed for in-camera processing, comprises:

(a) photographic element, as described above;
(b) a dye image-receiving layer; and
(c) an alkaline processing composition contained within means from which it can be discharged within the film unit;

the film unit containing a silver halide developing agent.

Various formats for diffusion transfer film units are known in the art. The layer arrangement employed with them can be used in the film units of this invention. In one useful format the dye-image-receiving layer of the film unit is located on a separate support adapted to be superposed on the photographic element after exposure thereof. Such image-receiving layers are generally disclosed, for example, in U.S. Pat. Nos. 3,362,819.

In another useful format the dye-image-receiving layer is integral with the photographic element and is positioned between the support and the lowermost silver halide emulsion layer. One such format is disclosed in Belgian Pat. No. 757,960. In such a format, the support for the photographic element is transparent and bears, in order, an image-receiving layer, a substantially opaque light-reflective layer and then the photosensitive layer or layers. After imagewise exposure, a rupturable container containing the alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer and dye images, formed as a function of development, diffuse to the image-receiving layer to provide a right-reading image which is viewed through the transparent support on the opaque reflecting layer backgrounds. For other details concerning the format of this particular integral film unit, reference is made to the above-mentioned Belgian Pat. No. 757,960.

Another format is disclosed in Belgian Pat. No. 757,959. In this embodiment, the support for the photographic element is transparent and bears, in order, the image-receiving layer, a substantially opaque, light-reflective layer and the photosensitive layer or layers. A rupturable container, containing an alkaline processing composition and an opacifier, is positioned between the uppermost emulsion layer and a transparent top sheet which has thereon a neutralizing layer and a timing layer. The film unit is placed in a camera exposed through the transparent top sheet and then passed through a pair of pressure-applying members in the camera as it is being removed therefrom. The pressure-applying members rupture the container and spread processing composition and opacifier over the photographic layers to commence development and protect the photosensitive layers from further light exposure. The processing composition develops each silver halide layer and dye images, formed as a result of development, diffuse to the image-receiving layer to provide a right-reading image which is viewed through the transparent support on the opaque reflecting layer background. For further details concerning the format of this particular integral film unit, reference is made to the above mentioned Belgian Pat. No. 757,959.

Still other useful formats in which this invention can be employed are described in U.S. Pat. Nos. 3,415,644; 3,415,645; 3,415,646; 3,647,437; 3,635,707; and 3,993,486.

The term "nondiffusible" used herein has the meaning commonly applied to the term in photography and denotes materials that for all practical purposes do not migrate nor wander through organic colloid layers such as gelatin in an alkaline mediu, in the photographic elements of the invention and preferably when processed in a medium having a pH of 11 or greater. The same meaning is to be attached to the term "immobile." The term "diffusible" as applied to the materials of this invention hs the converse meaning and denotes materials having the property of diffusing effectively through the colloid layers of the photographic elements in an alkaline medium. "Mobile" has the same meaning.

The term "associated therewith" as used herein is intended to mean that the materials can be in either the same or different layers so long as the materials are accessible to one another during processing.

The following examples further illustrate this invention.

PREPARATION EXAMPLE 1

N-(p-Nitrophenoxymethyl)phthalimide

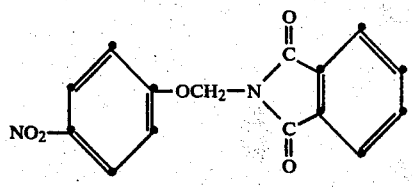

N-(Chloromethyl)phthalimide (4.2 g) and the yellow dye, p-nitrophenol (3.0 g) were dissolved sequentially in 100 ml of dimethylformamide (DMF). Sodium hydride (2.0 g of a 50% oil dispersion) was added and the solution stirred for three days at room temperature. The mixture was diluted with 500 ml 1% aqueous acetic acid to precipitate out the desired product: 5.6 g, m.p. 145°-148° C.

PREPARATIVE EXAMPLE 2

N[4-(4-nitrophenylazo)phenoxymethyl]phthalimide

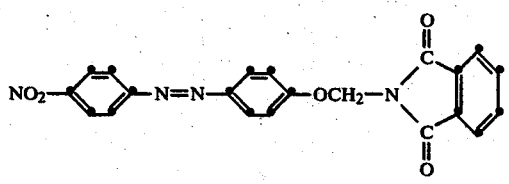

To a solution of the red dye, 4-(4-nitro-phenylazo)-phenol (0.5 g), in DMF was added sodium hydride (0.1 g of a 50% dispersion). After stirring for 5 minutes at room temperature, N-(chloromethyl)phthalimide (0.5 g) was added and stirring continued overnight. The solution was acidified with acetic acid and the product precipitated by pouring into ice water. The product recrystallized from ethyl acetate/cyclohexane, was obtained in 0.72 g yield, m.p. 182°-190° C.

PREPARATIVE EXAMPLE 3

Phthalimidomethyl
2-(5,6-Dihydroxy-2-pyridylazo)benzoate

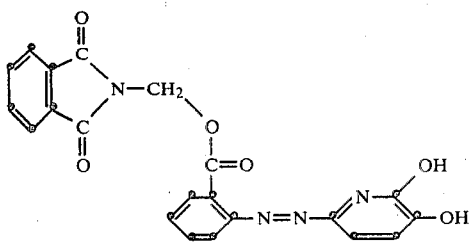

Phthalimidomethyl anthranilate (1.0 g) was dissolved in 20 ml tetrahydrofuran (THF), concentrated hydrochloric acid added (1 ml) and the solution cooled in an ice bath. With rapid stirring sodium nitrite (0.23 g dissolved in 1 ml water) was added and the mixture stirred for another 20 minutes. This solution was then added dropwise to an ice-cooled solution of 2,3-pyridinediol (0.4 g) and sodium acetate (2.0 g) in 50 ml of a 2:1 mixture by volume of methanol and water. On further stirring for 1 hour at 0° C. the dye precipitated. It was further diluted with 100 ml water and the mixture filtered. The precipitate was washed with water and dried. Yield 1.2 g, m.p. 196°-201° C. A thin layer chromatogram showed a single spot.

Phthalimidomethyl anthranilate

Phthalimidomethyl o-nitrobenzoate (10 g) dissolved in a mixture of 60 ml acetic acid and 150 ml THF was hydrogenated with 10% palladium on charcoal catalyst (0.5 g) in a Parr shaker apparatus for 1 hour. The solution was filtered and the filtrate concentrated in vacuo. The crystalline product precipirated and was filtered off yielding 7.0 g, m.p. 160°-162° C.

Phthalimidomethyl o-nitrobenzoate o-Nitrobenzoic acid (10.0 g) and dicyclohexylamine (11.0 g) were added in sequence to 100 ml DMF, more solvent being necessary to dissolve the resulting salt. N-(Chloromethyl)phthalimide was added and the mixture stirred for 24 hours. The product was precipitated out with water. Recrystallization from ethyl acetate/cyclohexane yielded 15.3 g (83%) of the ester, m.p. 159°-160° C.

Preparative Example 4-A Positive Redox Dye-Releaser

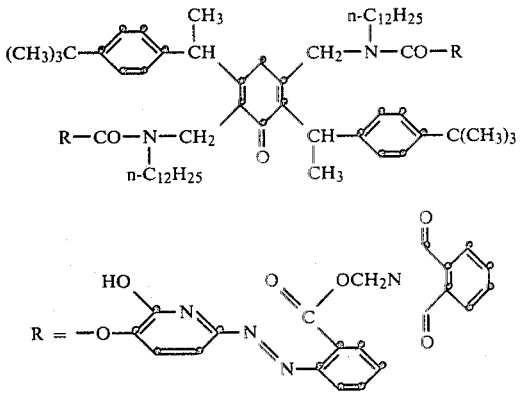

Phthalimidomethyl 2-(5,6-dihydroxy-2-pyridylazo)benzoate (from Preparative Example 3) (7.5 g, 18 mmole) was added to 250 ml pyridine and enough dimethylformamide was added to dissolve all of the dye. Then 2,5-bis [1-(p-t-butylphenyl)ethyl]-3,6-bis [N-(chloroformyl)-N-n-dodecylaminomethyl]benzoquinone (8.5 g, 9 mmole) was added and the solution stirred for 24 hours at room temperature. The solution was then concentrated in vacuo to a viscous oil which was poured into a dilute aqueous solution of acetic acid. The product, which solidified on stirring with the acidic solution, was filtered off, dried, and chromatographed on a column of silica gel from a 50/50 ethyl acetate/cyclohexane solution. 2.3 g of dye was confirmed as pure by thin-layer chromatography.

EXAMPLE 1

Relative Hydrolysis Rates of Esters of a Dye Carboxylic Acid

The hydrolysis rates of ester derivatives of a dye containing a carboxyl group were measured to compare phthalimidomethyl blocking groups with other ester blocking groups. The dye chosen, 2-(1-hydroxy-4-methyl-2-naphthylazo)benzoic acid was picked because of the 20 nm shift in maximum spectral absorption wavelength observed on hydrolysis of the ester to the free carboxylic acid.

The following test procedures were employed:

(1) This procedure was employed with dye esters having a rate constant more negative than about $10^{-1}$. Stock solutions of the esters ($4.5\times10^{-3}$ Molar) were made up in dioxane. 60 μl of the stock solution was injected into a reaction cuvette containing 2 ml of base, and the reaction was monitored at 550 nm with a conventional spectrophotometer. The base consisted of dioxane:0.25 Molar NaOH in a ratio of 1:1 by volume. The temperature was held at 25° C.

(2) This procedure, was employed with dye esters having a rate constant less negative than about $10^{-1}$, using a stopped-flow spectrophotometer, the ester was dissolved at a concentration of $4.5\times10^{-3}$ Molar in dioxane:water in a ratio of either 1:1 by volume or 2:1 by volume depending upon the solubility of the ester. This solution as introduced into one of two identical drive syringes. The other syringe contained dioxane:water in a ratio 1:1 by volume with 0.5 M NaOH. Percent transmission was recorded on an oscilloscope.

Psuedo first-order rate constants were calculated from the data obtained by each procedure. Good first-order kinetics were obtained.

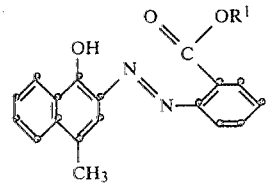

| $R^1$ | Rate Constant ($sec^{-1}$) |
|---|---|
| $-CH_3$ | $5.2\times10^{-3}$ |
| $-CH_2C_6H_5$ | $2.2\times10^{-3}$ |
| $-C_6H_5$ | $1.3\times10^{-2}$ |

-continued

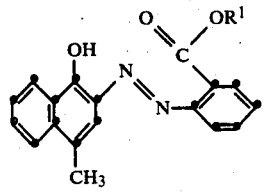

| $R^1$ | Rate Constant ($sec^{-1}$) |
|---|---|
| 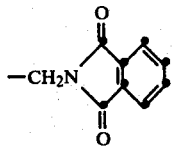 | $4.5 \times 10^1$ |
| 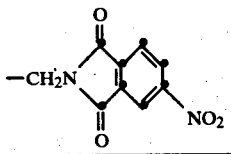 | $9.2 \times 10^2$ |

The rates of hydrolysis of the phthalimido esters were 2 to 5 orders of magnitude greater than the other esters.

EXAMPLE 2

Dye Release Rates From Dye Releasing Compounds

In this example the release rate of dyes from dye releasing compounds were determined in a photographic format. The rates of dye release from the phthalimide ester derivatives were compared with those of the free acids and of other esters.

The dye releasing compounds were coated in a color diffusion transfer film unit having the schematic structure shown below. All coverages are in $g/m^2$ unless indicated otherwise.

| | |
|---|---|
| Gelatin overcoat | Gelatin (0.54) |
| Imaging layer: | Red-sensitive silver iodobromide emulsion (1.34) in gelatin (2.15); a codispersion of the dye releasing compound and an electron donor (see below) with a development inhibitor releaser (0.022) in dibutyl phthalate solvent |
| Interlayer: | Gelatin (1.18) |
| Opaque Layer: | Carbon (1.24) dispersed in gelatin (1.88) |
| Reflective Layer: | $Ti_2$ (16.1) dispersed in gelatin (2.58) |
| Mordant/Receiver Layer: | (a) Mordant (2.15) in gelatin (2.15) |
| Metallizing Layer: | (b) $NiSO_4.6H_2O$ (0.58) in gelatin (1.08) |
| Transparent Polyester Support | |

The dye releasing compound was coated at $21.5 \times 10^{-5}$ moles/$m^2$ for the cyan dyes shown below or $25.2 \times 10^{-5}$ moles/$m^2$ for the magenta dyes shown below, codispersed with the electron donor at twice the molar weight concentration of dye releasing compound.

The electron donor employed was:

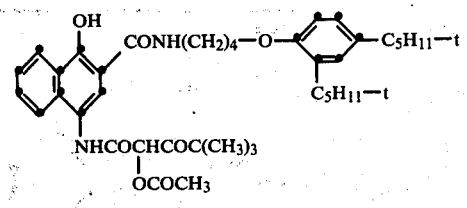

The development inhibitor releaser employed was:

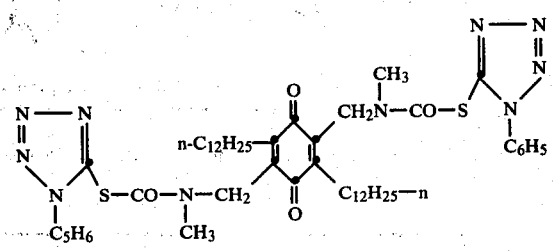

The mordant employed was: poly(styrene-co-1-vinylimidazole-co-3-benzyl-1-vinylimidazolium chloride) (50/40/10).

In order to measure the maximum rate of dye appearance on the receiver, samples of the film unit were processed without exposure at room temperature by rupturing a pod containing a viscous solution comprising 51 g potassium hydroxide and 57 g carboxymethylcellulose per liter of water between the film unit and a sheet of clear polyester support. The samples were peeled apart after 30 seconds, 1, 3, 5, 10 and 20 minutes, respectively and the density values measured. From these measurements there are obtained plots of density versus time, and from the plots $t_{\frac{1}{2}}$ values were calculated. The $t_{\frac{1}{2}}$ value is the time at which half of the $D_{max}$ is attained.

The dyes employed had the basic structure:

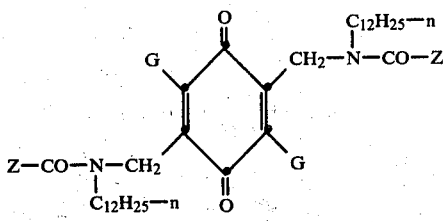

The cyan dyes and the results obtained are shown below.

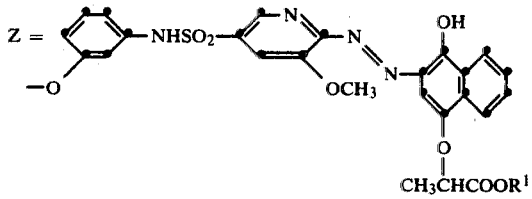

| Compound | G | $R^1$ | $t_{\frac{1}{2}}$ |
|---|---|---|---|
| Free Acid | 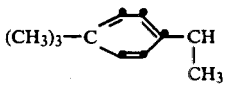 | —H | 60 seconds |
| Phthalimido Ester | 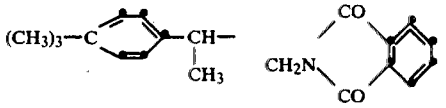 | | 90 seconds |
| Phthalimido Ester | 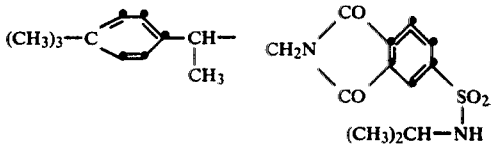 | | 65 seconds |

The magenta dyes and the results obtained are shown below:

It can be seen that with the cyan dyes the inventive esters have only a slightly longer $t_{\frac{1}{2}}$ than the free car-

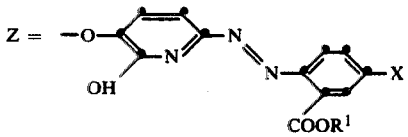

| Compound | G | X | $R^1$ | $t_{\frac{1}{2}}$ |
|---|---|---|---|---|
| Free Acid | 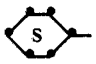 | Cl | —H | 40 seconds |
| Phthalimido Ester | 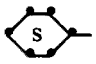 | Cl | | 25 seconds |
| Free Acid | 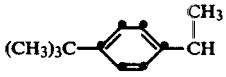 | Cl | —H | 50 seconds |
| Phthalimido Ester | 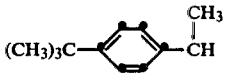 | Cl | | 20 seconds |
| Methyl Ester | 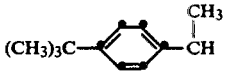 | —H | —$CH_3$ | 132 seconds |
| Phthalimido Ester | 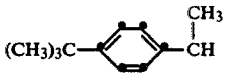 | —H | | 40 seconds |

boxyl compound and, with the magenta dyes, the inventive esters have $t_{\frac{1}{2}}$'s significantly faster than the methyl ester and, unexpectedly, even faster than the free acid.

This invention has been described in detail with particular reference to certain preferred embodiments thereof, but is will be understood that variations and modifications can be effected within the spirit and scope of the invention.

What is claimed is:

1. In a photographic image transfer film unit comprising:

(a) a photosensitive element comprising a support bearing a layer of a silver halide emulsion having associated therewith a nondiffusible dye-image-providing material, and (b) a dye-image-receiving layer, the improvement wherein the dye-image-providing material is an imidomethyl blocked dye-releasing compound having the structure:

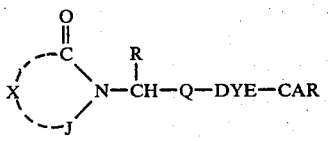

wherein:

J represents

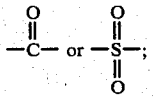

X represents the atoms to complete a heterocyclic nucleus containing at least one 5- or 6-membered ring;

R represents hydrogen, alkyl of 1 to 4 carbon atoms or aryl of 6 to 12 carbon atoms;

Q represents

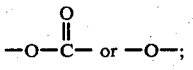

—Q—DYE represents the residue of a diffusible photographic dye; and

CAR is a ballasted carrier moiety from which the dye moiety is released as a function of silver halide development.

2. In a photographic image transfer film unit comprising:

(a) A photosensitive element comprising a support having thereon a red-sensitive silver halide emulsion unit having associated therewith a cyan-dye-image-providing material, a green-sensitive silver halide emulsion unit having associated therewith a magenta-dye-image-providing material and a blue-sensitive silver halide emulsion unit having associated therewith a yellow-dye-image-providing material; and (b) a dye-image-receiving layer; the improvement wherein at least one of the dye-image-providing materials is a non-diffusible imidomethyl blocked dye-releasing compound having the structure:

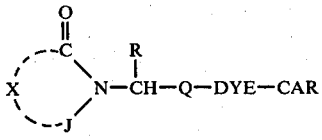

wherein:

J represents

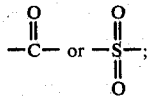

X represents the atoms to complete a heterocyclic nucleus containing at least one 5- or 6-membered ring;

R represents hydrogen, alkyl of 1 to 4 carbon atoms or aryl of 6 to 12 carbon atoms;

Q represents

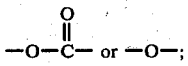

—Q—DYE represents the residue of a diffusible photographic dye; and

CAR is a ballasted carrier moiety from which the dye moiety is released as a function of silver halide development.

3. A film unit of claim 2 further comprising an alkaline processing composition and means containing same for discharge of the alkaline processing composition within the film unit.

4. A film unit of claim 3 further comprising a transparent cover sheet on the opposite side of the silver halide emulsion layers from the dye-image-receiving layer, and the means containing the alkaline processing composition being positioned for discharge of the alkaline processing composition between the cover sheet and the silver halide emulsion layers.

5. A film unit of claim 4 wherein the cover sheet comprises a transparent support bearing, in order, a neutralizing layer and a timing layer.

6. A film unit of any one of claims 1 or 2 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

7. A film unit of any one of claims 1 or 2 wherein the imidomethyl blocking group has one of the structures:

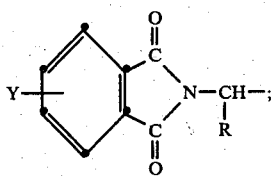

-continued

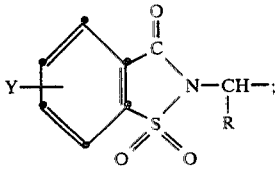

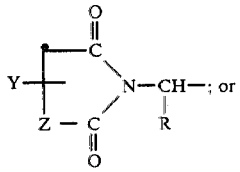

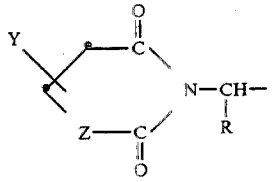

wherein:

R represents hydrogen, alkyl of 1 to 4 carbon atoms or aryl of 6 to 12 carbon atoms;

Z is

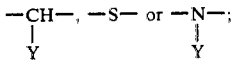

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsuklfonyl, alkenylsulfonyl, amino, sulfonamido, aminocarbonyl, aminosulfonyl, carboxy, alkoxycarbonyl, aryloxycarbonyl and alkenyloxycarbonyl.

8. A film unit of any one of claims 1–5 wherein the imidomethyl blocked dye releasing compound has the structure:

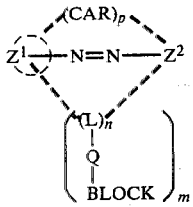

wherein:

$Z^1$ represents the atoms to complete an aromatic carbocyclic or heterocyclic nucleus having at least one ring of 5 to 7 atoms;

$Z^2$ represents a nucleus as defined for $Z^1$ or an acyclic unsaturated group in conjugation with the azo group;

CAR is a ballasted carrier moiety from which the dye moiety is released as a function of silver halide development;

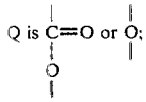

BLOCK is an imidomethyl blocking group having the structure:

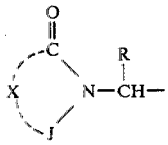

wherein:

J represents

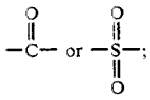

X represents the atoms to complete a heterocyclic nucleus containing at least one 5- or 6-membered ring;

R represents hydrogen, alkyl of 1 to 4 carbon atoms or aryl of 6 to 12 carbon atoms;

L is a bivalent linking group;

m is 1 or 2;

n is 0 or 1 when Q is

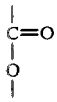

and is 0 when Q is 0; and p is ½, 1 or 2.

9. A film unit of claim 8 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

10. A film unit of claim 8 wherein the imidomethyl blocking group has one of the structures:

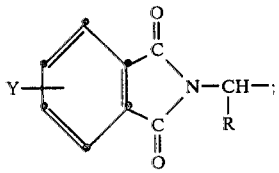

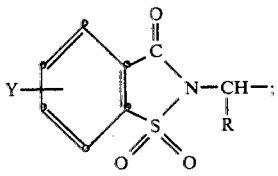

-continued

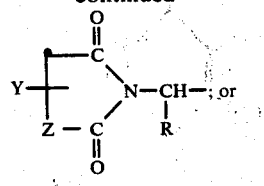

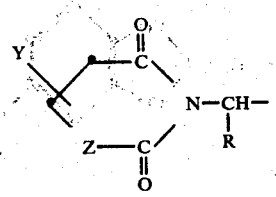

wherein:

R represents hydrogen, alkyl of 1 to 4 carbon atoms or aryl of 6 to 12 carbon atoms;

Z is

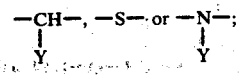

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl and alkenyloxycarbonyl.

11. A film unit of claim 8 wherein CAR is a ballasted ortho or para-sulfonamidophenol or —naphthol carrier, the dye moiety being joined to the carrier moiety through the sulfonamido group ortho or para to the phenolic hydroxy group and being releasable therefrom after oxidation of the carrier moiety.

12. A film unit of claim 8 wherein CAR is a ballasted nitrobenzene or quinone carrier, the dye moiety being joined to the carrier moiety through an electrophilic cleavage group ortho to the nitro group or the quinone oxygen atom and being releasable therefrom upon reduction of the carrier moiety.

13. A film unit of any one of claims 1–5 wherein the imidomethyl blocked dye releasing compound has the structure:

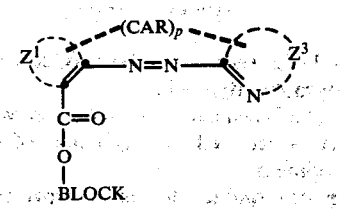

wherein:

p is ½, 1 or 2;

$Z^1$ represents the atoms to complete an aromatic carbocyclic or heterocyclic nucleus having at least one ring of 5 to 7 atoms;

$Z^3$ represents the atoms to complete an aromatic heterocyclic nitrogen containing nucleus having at least one ring of 5 to 7 atoms;

CAR is a ballasted carrier moiety from which the dye moiety is released as a function of silver halide development; and BLOCK is an imidomethyl blocking group having the structure:

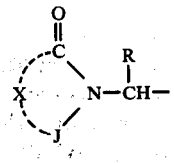

wherein:

J represents

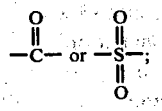

X represents the atoms to complete a heterocyclic nucleus containing at least one 5- or 6-membered ring; and R represents hydrogen, alkyl of 1 to 4 carbon atoms or aryl of 6 to 12 carbon atoms.

14. A film unit of claim 13 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

15. A film unit of claim 13 wherein the imidomethyl blocking group has one of the structures:

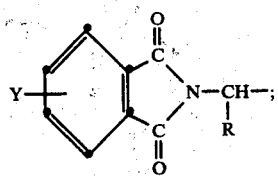

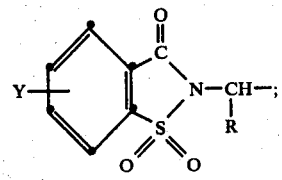

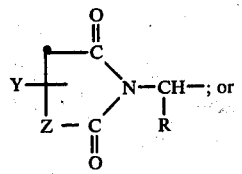

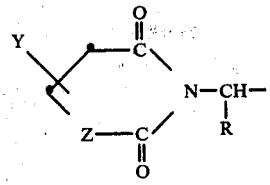

wherein:

R represents hydrogen, alkyl of 1 to 4 carbon atoms or aryl of 6 to 12 carbon atoms;

Z is

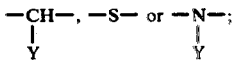

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl and alkenyloxycarbonyl.

16. A film unit of claim 13 wherein CAR is a ballasted ortho- or para-sulfonamidophenol or —naphthol carrier, the dye moiety being joined to the carrier moiety through the sulfonamido group ortho or para to the phenolic hydroxy group and being releasable therefrom after oxidation of the carrier moiety.

17. A film unit of claim 13 wherein CAR is a ballasted nitrobenzene or quinone carrier, the dye moiety being joined to the carrier moiety through an electrophilic cleavage group ortho to the nitro group or the quinone oxygen atom and being releasable therefrom upon reduction of the carrier moiety.

18. A film unit of one of claims 1 or 2 wherein the imidomethyl dye releasing compound has the structure:

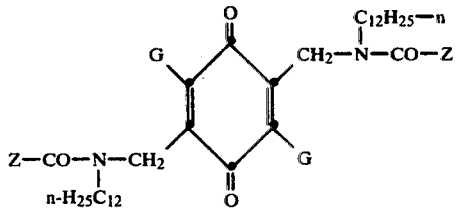

wherein:

G is

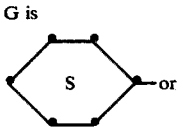

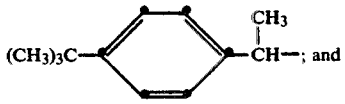

Z is

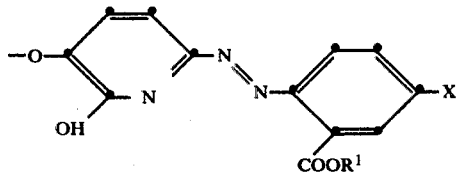

where:

X is H or Cl; and $R^1$ is

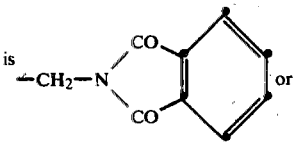

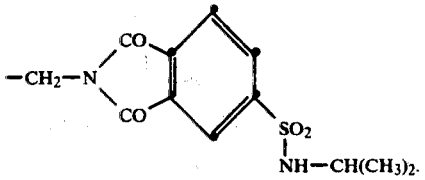

19. A photographic element comprising a support bearing a photosensitive silver halide emulsion having associated therewith an imidomethyl blocked dye or dye releasing compound having the structures:

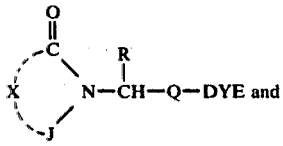

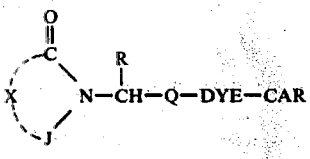

wherein:

J represents

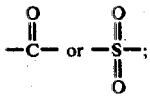

X represents the atoms to complete a heterocyclic nucleus containing at least one 5- or 6-membered ring;

R represents hydrogen, alkyl of 1 to 4 carbon atoms or aryl of 6 to 12 carbon atoms;

Q represents

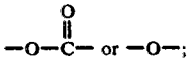

—Q—DYE represents the residue of a diffusible photographic dye; and

CAR is a ballasted carrier moiety from which the dye moiety is released as a function of silver halide development.

20. A photographic element comprising a support having thereon a red-sensitive silver halide emulsion unit having associated therewith a cyan-dye-image providing material, a green-sensitive silver halide emulsion unit having associated therewith a magenta-dye-image-providing material and a blue-sensitive silver halide emulsion unit having associated therewith a yellow-dye-image providing material, at least one of the dye image providing materials being an imidomethyl blocked dye or dye releasing compound having the structures:

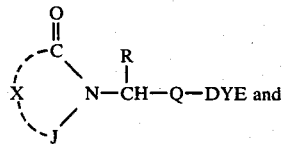

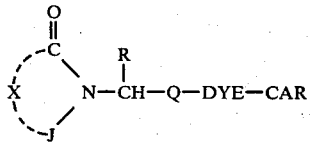

wherein:

J represents

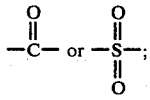

X represents the atoms to complete a heterocyclic nucleus containing at least one 5- or 6-membered ring;

R represents hydrogen, alkyl of 1 to 4 carbon atoms or aryl of 6 to 12 carbon atoms;

Q represents

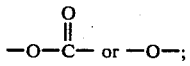

—Q—DYE represents the residue of a diffusible photographic dye; and

CAR is a ballasted carrier moiety from which the dye moiety is released as a function of silver halide development.

21. An element of any one of claims 19 or 20 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

22. A element of any one of claims 19 or 20 wherein the imidomethyl blocking group has one of the structures:

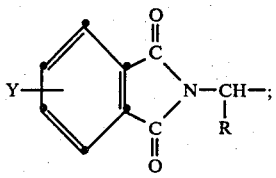

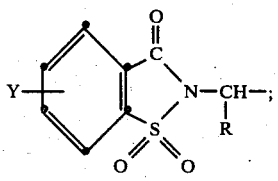

-continued

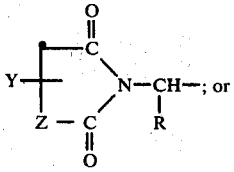

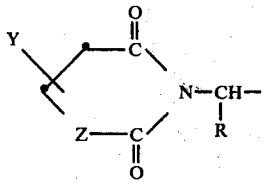

wherein:

R represents hydrogen, alkyl of 1 to 4 carbon atoms or aryl of 6 to 12 carbon atoms;

Z is

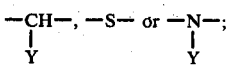

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl and alkenyloxycarbonyl.

23. An element of any one of claims 19 or 20 wherein the imidomethyl blocked dye and dye releasing compound have the structures:

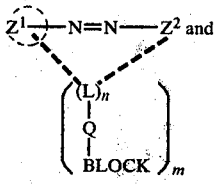

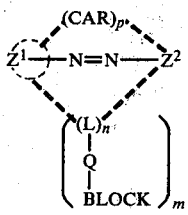

wherein:

$Z^1$ represents the atoms to complete an aromatic carbocyclic or heterocyclic nucleus having at least one ring of 5 to 7 atoms;

$Z^2$ represents a nucleus as defined for $Z^1$ or an acyclic unsaturated group in conjugation with the azo group;

CAR is a ballasted carrier moiety from which the dye moiety is released as a function of silver halide development;

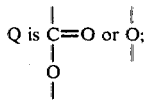

BLOCK is an imidomethyl blocking group having the structure:

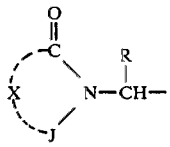

wherein:

J represents

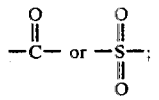

X represents the atoms to complete a heterocyclic nucleus containing at least one 5- or 6-membered ring;

R represents hydrogen, alkyl of 1 to 4 carbon atoms or aryl of 6 to 12 carbon atoms;

L is a bivalent linking group;

m is 1 or 2;

n is 0 or 1 when Q is

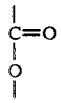

and is 0 when Q is O;

and p is ½, 1 or 2.

24. An element of claim 23 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

25. A element of claim 23 wherein the imidomethyl blocking group has one of the structure:

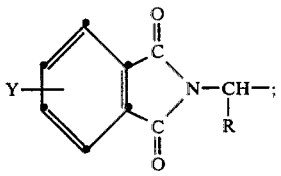

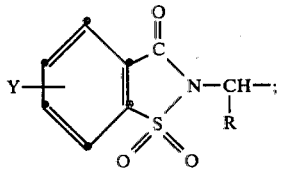

-continued

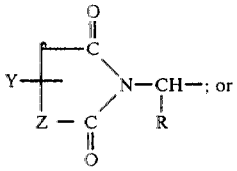

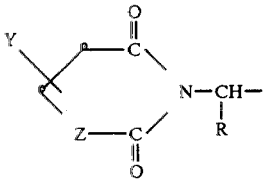

wherein:

R represents hydrogen, alkyl of 1 to 4 carbon atoms or aryl of 6 to 12 carbon atoms;

Z is

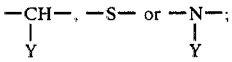

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl and alkenyloxycarbonyl.

26. An element of any one of claims 19 or 20 wherein the imidomethyl blocked dye and dye releasing compound have the structures:

IX

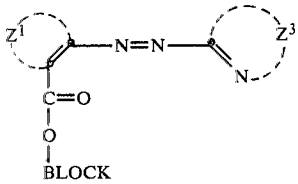

and

X

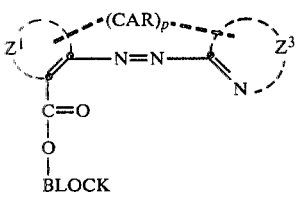

wherein:

p is ½, 1 or 2;

$Z^1$ represents the atoms to complete an aromatic carbocyclic or heterocyclic nucleus having at least one ring of 5 to 7 atoms;

$Z^3$ represents the atoms to complete an aromatic heterocyclic nitrogen containing nucleus having at least one ring of 5 to 7 atoms;

CAR is a ballasted carrier moiety from which the dye moiety is released as a function of silver halide development; and BLOCK is an imidomethyl blocking group having the structure:

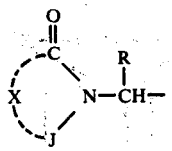

wherein:

J represents

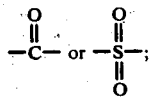

and

X represents the atoms to complete a heterocyclic nucleus containing at least one 5- or 6-membered ring; and R represents hydrogen, alkyl of 1 to 4 carbon atoms or aryl of 6 to 12 carbon atoms.

27. An element of claim 26 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

28. An element of claim 26 wherein the imidomethyl blocking group has one of the structures:

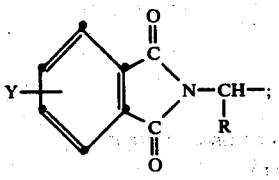

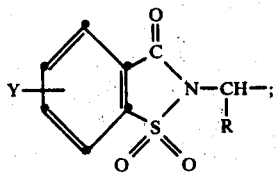

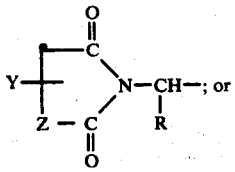

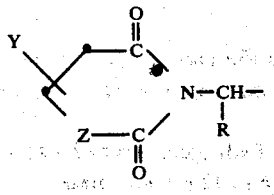

wherein:

R represents hydrogen, alkyl of 1 to 4 carbon atoms or aryl of 6 to 12 carbon atoms;

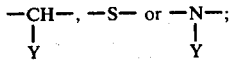

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl and alkenyloxycarbonyl.

29. A process for producing a photographic image comprising:

(a) treating an imagewise-exposed photographic film unit of any one of claims 1 or 2, with an alkaline processing composition in the presence of a silver halide developing agent to unblock the dye and effect development of each of the exposed silver halide emulsion layers;

(b) said dye-releasing compound releasing said dye imagewise as a function of development of each of said silver halide emulsion layers;

(c) at least a portion of said imagewise distribution of said dye diffusing out of the layer in which it is coated.

30. A process of claim 29 wherein after cleaving from the dye-releasing compound the dye diffuses to a dye-image-receiving layer to provide a transfer image.

31. A process of claim 29 wherein after cleaving from the dye-releasing compound the dye is removed from the element while retaining in the element an imagewise distribution of unblocked dye releasing compound to provide a retained image.

32. An imidomethyl blocked dye or dye releasing compound having one of the structures:

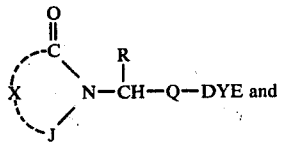

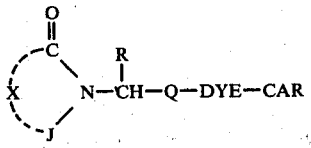

wherein:

J represents

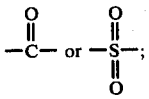

Y represents the atoms to complete a heterocyclic nucleus containing at least one 5- or 6-membered ring;

R represents hydrogen, alkyl of 1 to 4 carbon atoms or aryl of 6 to 12 carbon atoms;

Q represents

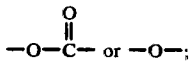

—Q—DYE represents the residue of a diffusible photographic dye; and

CAR is a ballasted carrier moiety from which the dye moiety is released as a function of silver halide development.

33. A compound of claim 32 wherein X represents the atoms to complete a ring system selected from the group consisting of phthalimide, saccharin, succinimide, maleimide, hydantoin, 2,4-thiazolidinedione, hexahydro-2,4-pyrimidinedione, and 1,2,3,6-tetrahydrophthalimide ring systems.

34. A comound of claim 32 wherein the imidomethyl blocking group has one of the structures:

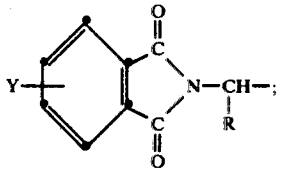

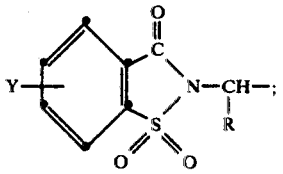

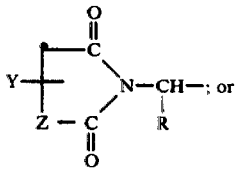

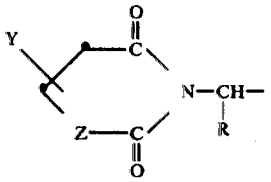

wherein:

R represents hydrogen, alkyl of 1 to 4 carbon atoms or aryl of 6 to 12 carbon atoms;

Z is

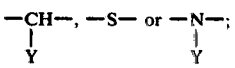

and

Y is hydrogen or one or more substituents selected from the group consisting of halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, sulfonamido, aminocarbonyl, aminosulfonyl, carboxy, alkoxycarbonyl, aryloxycarbonyl and alkenyloxycarbonyl.

35. A compound of claim 32 having one of the structures:

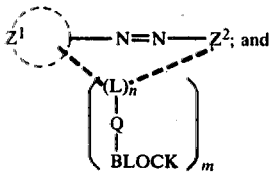

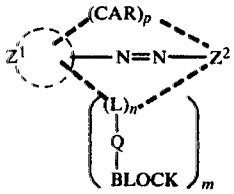

wherein:

$Z^1$ represents the atoms to complete an aromatic carbocyclic or heterocyclic nucleus having at least one ring of 5 to 7 atoms;

$Z^2$ represents a nucleus as defined for $Z^1$ or an acyclic unsaturated group in conjugation with the azo group;

CAR is a ballasted carrier moiety from which the dye moiety is released as a function of silver halide development;

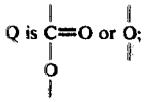

BLOCK is an imidomethyl blocking group having the structure:

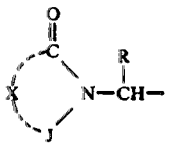

wherein:

J represents

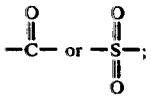

X represents the atoms to complete a heterocyclic nucleus containing at least one 5- or 6-membered ring;

R represents hydrogen, alkyl of 1 to 4 carbon atoms or aryl of 6 to 12 carbon atoms;

L is a bivalent linking group;

m is 1 or 2;

n is 0 or 1 when Q is

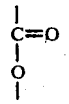

and is 0 when Q is O; and p is ½, 1 or 2.

36. A compound of claim 32 having one of the structures:

IX

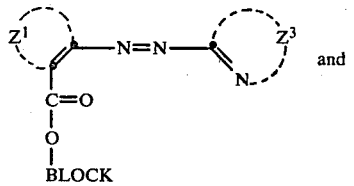

and

X

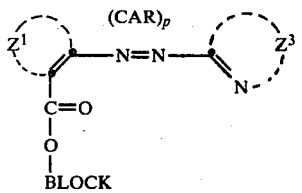

wherein:

p is ½, 1 or 2;

$Z^1$ represents the atoms to complete an aromatic carbocyclic or heterocyclic nucleus having at least one ring of 5 to 7 atoms;

$Z^3$ represents the atoms to complete an aromatic heterocyclic nitrogen con;taining nucleus having at least one ring of 5 to 7 atoms;

CAR is a ballasted carrier moiety from which the dye moiety is released as a function of silver halide development; and BLOCK is an imidomethyl blocking group having the structure:

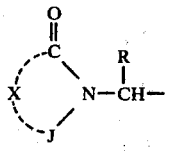

wherein:

J represents

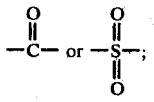

X represents the atoms to complete a heterocyclic nucleus containing at least one 5- or 6-membered ring; and R represents hydrogen, alkyl of 1 to 4 carbon atoms or aryl of 6 to 12 carbon atoms.

* * * * *